US006675521B1

(12) United States Patent
Kim

(10) Patent No.: US 6,675,521 B1
(45) Date of Patent: Jan. 13, 2004

(54) APPARATUS AND METHOD FOR ADJUSTING ORIENTATION OFFSET OF A LIGHT BEAM GENERATOR

(75) Inventor: Paul Y. Kim, Westminster, CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

(21) Appl. No.: 10/299,326

(22) Filed: Nov. 18, 2002

(51) Int. Cl.[7] ..... F41G 1/00
(52) U.S. Cl. ..... 42/114; 42/146
(58) Field of Search ..... 42/114, 115, 124, 42/125, 126, 146

(56) References Cited

U.S. PATENT DOCUMENTS

| | | | | | |
|---|---|---|---|---|---|
| 1,595,023 | A | * | 8/1926 | Probe | 362/102 |
| 1,865,127 | A | | 6/1932 | McKeen | 362/119 |
| 1,879,622 | A | * | 9/1932 | Jones | 362/197 |
| 3,111,277 | A | * | 11/1963 | Grimsley | 362/197 |
| 3,359,383 | A | * | 12/1967 | Cryer | 200/43.08 |
| 3,739,167 | A | | 6/1973 | Avery | 240/2 |
| 5,064,988 | A | * | 11/1991 | E'nama et al. | 219/121.6 |
| 5,188,450 | A | * | 2/1993 | Anderson | 362/194 |
| 5,299,375 | A | * | 4/1994 | Thummel et al. | 42/115 |
| 5,345,707 | A | * | 9/1994 | Randall | 42/117 |
| 5,351,429 | A | * | 10/1994 | Ford | 42/115 |
| 5,400,540 | A | | 3/1995 | Solinsky et al. | 42/103 |
| 5,581,898 | A | * | 12/1996 | Thummel | 42/117 |
| 5,642,932 | A | | 7/1997 | Matthews | 362/206 |
| 5,749,644 | A | * | 5/1998 | Carbone | 362/198 |
| 6,276,088 | B1 | | 8/2001 | Matthews et al. | 42/103 |
| 6,345,464 | B1 | | 2/2002 | Kim et al. | 42/114 |
| 6,363,648 | B1 | * | 4/2002 | Kranich et al. | 42/117 |
| 6,397,509 | B1 | * | 6/2002 | Langner | 42/116 |
| 6,565,229 | B2 | * | 5/2003 | Bliss | 362/198 |

OTHER PUBLICATIONS

LASER PRODUCTS, Sure–Fire Catalog "Tactical Light and Laser Sight Product Selection Guide"(Aug. 1998), in particular pp. 9, 13 and 15 thereof.

* cited by examiner

*Primary Examiner*—Charles T. Jordan
*Assistant Examiner*—Denise J Buckley
(74) *Attorney, Agent, or Firm*—David Weiss

(57) ABSTRACT

Apparatus and method for adjusting orientation offset of a light source housing of a light beam generator mounted to a firearm, in such manner as to preclude inadvertent rotational displacement of the light source housing. The apparatus includes a coupler secured to the light source housing and adapted for being longitudinally placed for interfacing with and fastenable to the battery housing for incrementally adjusting orientation offset of the light source housing.

25 Claims, 2 Drawing Sheets

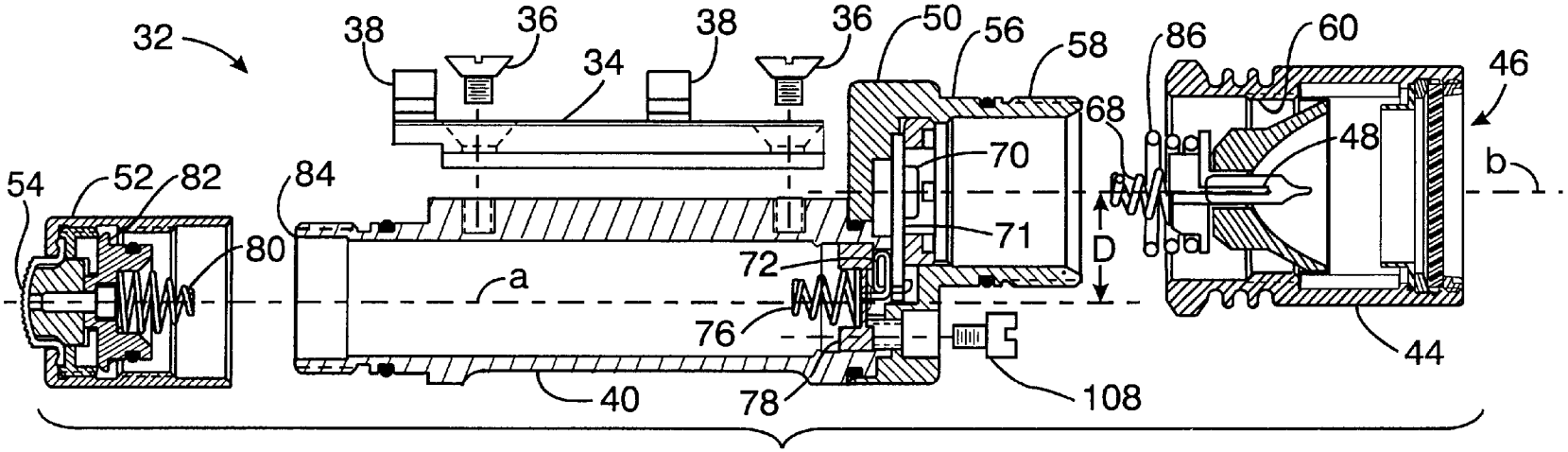
Fig. 3
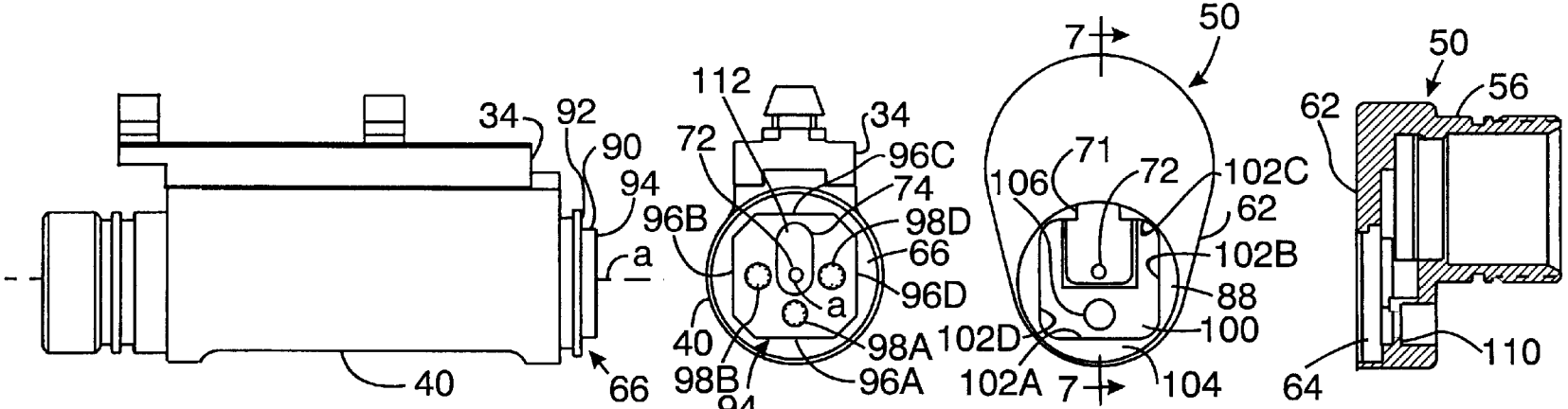
Fig. 7
Fig. 6
Fig. 5
Fig. 4

APPARATUS AND METHOD FOR ADJUSTING ORIENTATION OFFSET OF A LIGHT BEAM GENERATOR

BACKGROUND OF THE INVENTION

This invention relates to light beam generators for firearms, such as target illuminators and lasers sights, and more particularly to apparatus and methods for adjusting orientation offset of a light beam generator mounted to a firearm.

Firearm mounted light beam generators are well known. Target illuminators have been used on firearms for illuminating targets, and laser sights have been mounted to firearms for assisting in aiming the firearm. Such light beam generators are mounted to the firearm such that the generated light beam is parallel to and preferably close to the longitudinal axis of the firearm's barrel.

In certain mounting configurations, it may be desired to bring the light source housing closer to the barrel, or farther away from the barrel such as for avoiding other firearm accessories or when large diameter light source housings are employed. In such configurations, the light generator light source housing may be offset from its battery housing which is typically mounted to the firearm or to a rail interface system mounted to the firearm. In many situations, it may be desired to adjust the orientation of the offset on a mounted light beam generator.

In the past and present, adjustable offset capability has been used in firearm mounted light beam generators. In one manner of adjusting orientation offset, a typically cylindrical battery housing of the light source generator may be inserted in a U-shaped holder mounted to the firearm, the battery housing rotated in the holder for placing an included offset arm in a desired orientation, and then clamping the battery housing in such position. In another manner of adjusting orientation of an offset, the cylindrical battery housing may be made in two parts, one part being mounted to the firearm and the second part including an offset leg, the second part being adapted to screw into the mounted portion to a desired orientation of the offset leg and then locking it there. In either type, the battery housing or the battery housing portion including the offset leg are subject to undesired rotational displacement when inadvertently hit or when jarred or vibrated as by forces generated by the firing of the firearm.

SUMMARY OF THE INVENTION

The present invention provides a method and apparatus for adjusting orientation offset of a light source housing of a light beam generator mounted to a firearm, in such manner as to preclude inadvertent rotational displacement of the offset light source housing. According to one aspect of the present invention, a light beam generator apparatus is provided for a firearm having a barrel, comprising the combination of: a battery housing having a first longitudinal axis and adapted to be secured to the firearm with the first longitudinal axis parallel to the barrel; a light source housing having a second longitudinal axis; a coupler secured to the light source housing, the coupler and the battery housing adapted for longitudinally placing the coupler to the battery housing with the second longitudinal axis parallel to the first longitudinal axis and spaced from the first longitudinal axis along one or another of at least two angular dispositions of the second longitudinal axis with respect to the first longitudinal axis; and a fastener fastening the coupler to the battery housing when the coupler is placed to the battery housing with the second longitudinal axis along one or another of the at least two angular dispositions. The light source housing may house either a lamp assembly for illuminating a target, or a laser assembly for assisting aiming of the firearm.

The battery housing includes a front end, and the coupler includes a rear end interfacing with the front end when the coupler is longitudinally placed to the battery housing. One of such ends (preferably the battery housing front end) includes a longitudinal projection and the other of such ends (preferably the coupler rear end) includes a longitudinal recess for longitudinally receiving the projection, the projection and the recess configured for longitudinally placing the coupler to the battery housing with the second longitudinal axis along one or another of the at least two angular dispositions.

In a preferred embodiment, the longitudinal projection of the battery carrier front end includes at least two lateral surfaces spaced about the first longitudinal axis, and the longitudinal recess in the coupler rear end includes at least two lateral surfaces complementing the lateral surfaces of the front end when the projection is received by the recess, the angular dispositions of the surfaces about the first longitudinal axis corresponding to the angular dispositions of the second longitudinal axis with respect to the first longitudinal axis when the projection is received by the recess. The fastener preferably includes a threaded screw, a bore through the coupler's rear end for receiving the screw, and at least two threaded longitudinal bores in the battery housing front end spaced about the first longitudinal axis such that the screw is threadably received by one or another of the threaded bores corresponding to one or another of the at least two angular dispositions of the second longitudinal axis.

The lateral surfaces of the longitudinal projection are preferably along sides of a polygon, preferably an equilateral polygon, and the lateral surfaces of the longitudinal recess are respectively along sides of a polygon, preferably an equilateral polygon, the polygon of the longitudinal projection being centered along the first longitudinal axis, and the lateral surfaces of the projection fittingly engaging the lateral surfaces of the recess when the projection is received by the recess for preventing rotation of the coupler about the first longitudinal axis along one or another of the at least two angular dispositions. In the preferred embodiment, the polygons are squares, and successive ones of the angular dispositions are separated by 90°.

According to another aspect of the present invention, a method is provided of adjusting orientation offset of a light beam generator for a firearm having a barrel, comprising: providing a light beam generator including a battery housing having a first longitudinal axis, a light source housing having a second longitudinal axis, and a coupler secured to the light source housing; longitudinally placing the coupler to the battery housing with the second longitudinal axis parallel to the first longitudinal axis and spaced from the first longitudinal axis along one of at least two angular dispositions of the second longitudinal axis with respect to the first longitudinal axis; and fastening the coupler to the battery housing. The method further includes: unfastening the coupler from the battery housing; longitudinally withdrawing the coupler from the battery housing; longitudinally replacing the coupler to the battery housing with the second longitudinal axis along another of the angular dispositions; and fastening the coupler to the battery housing.

The battery housing has a front end and the coupler has a rear end, one of such ends includes a longitudinal projection and the other of such ends includes a longitudinal recess; and when longitudinally placing the coupler, the projection is received by the recess with the second longitudinal axis along one of the angular dispositions.

The longitudinal projection includes lateral surfaces respectively along sides of a preferably equilateral polygon, preferably a square, centered along the first longitudinal axis, and the longitudinal recess includes lateral surfaces respectively along sides of a preferably equilateral polygon, preferably a square; and when longitudinally placing the coupler, the projection is received by the recess such that the lateral surfaces of the projection engage the lateral surfaces of the recess.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

FIG. 3 is an exploded longitudinal generally cross-sectional view of the preferred embodiment shown in FIG. 2, with an included lamp assembly for illuminating a target;

FIG. 4 is a top plan view of the battery housing and mount shown-in FIGS. 2 and 3;

FIG. 5 is a view of the front end of the preferred embodiment battery housing and mount of FIGS. 3 and 4;

FIG. 6 is a view of the rear end of a coupler included in the preferred embodiment shown in FIG. 3;

FIG. 7 is a cross-sectional view of the coupler housing of FIGS. 3 and 6, taken along the line 7—7 of FIG. 6 in the direction of the appended arrows;

DETAILED DESCRIPTION OF THE PREFERRED EMBODIMENT

Figure 1:
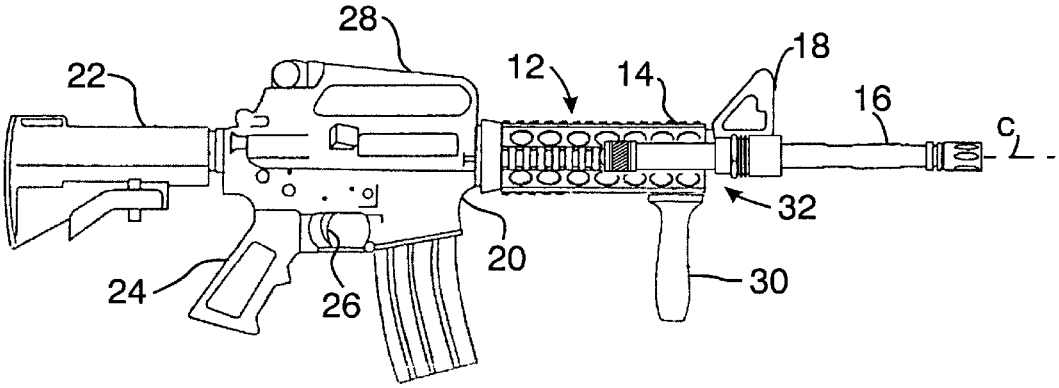
FIG. 1 is an elevation view of a preferred embodiment of an adjustable orientation offset light generator apparatus according to the present invention, mounted to a firearm.

Turning first to FIG. 1, there is illustrated a firearm 12, specifically a carbine such as manufactured by Colt Firearms (Division of Colt Industries, of Hartford, Conn.), equipped with a rail interface system device 14 such as manufactured by Knights Manufacturing Co. (of Vero Beach, Fla.) secured to the carbine and surrounding the carbine's barrel 16 along the carbine's fore-end section between the front sight 18 and the lower receiver 20. The carbine 12 further includes a stock 22, pistol grip 24, trigger 26 and upper receiver 28 with (in this example) carrying handle and rear sight. A fore grip or handgrip 30 is mounted to the underside of the rail interface device 14, in a position such that the user of the firearm 12 may comfortably grasp the handgrip 30 with one hand while the user's other hand grasps the pistol grip 24 for facilitating firing of the firearm 12. Such carbines 12, rail interface system devices 14, and handgrips 30 are well known in the firearms art.

A preferred embodiment of an adjustable orientation offset light generator apparatus 32 according to the present invention is mounted to the rail interface device 14 by means of a mounting plate 34 secured to the housing of the light generator 32 (such as by screws 36, see FIG. 3) and including projections 38 cooperating with the rail interface device 14 for removably mounting the light generator 32 thereto.

As best shown in FIGS. 2–7, the preferred embodiment of the adjustable orientation offset light generator 32 includes a generally cylindrical battery housing 40 having a first longitudinal axis a, for holding a battery such as the two battery cells 42 (FIG. 2), a generally cylindrical light source housing 44 having a second longitudinal axis b and equipped with a lamp assembly 46 including a lamp 48, a coupler 50 secured to the light source housing 44 along the light source housing's longitudinal axis b as well as to the battery housing 40 along the battery housing's longitudinal axis a. The lamp 48 is in electrical circuit with the batteries 42 in the battery housing 40, through the coupler 50, and a rear cap assembly 52 including a rearwardly projecting pushbutton switch 54 may be provided for actuating the batteries 44 to energize the lamp 48. Such lamp assemblies 46 and rear cap pushbutton switch assemblies 52 may be of the types shown, for example, in U.S. Pat. No. 5,642,932 to John W. Matthews, assigned to the assignee of the present invention, the disclosure of which Matthews patent is incorporated herein by reference.

The coupler 50 includes a forwardly directed tubular portion 56 having external threads 58 to which the light source housing 44 is secured by means of the light source housing's cooperating internal threads 60. When so secured, the coupler's tubular portion 56 and the generally cylindrical light source housing 44 are longitudinally aligned along the light source housing's longitudinal axis b.

The coupler 50 includes an offset leg portion 62 having a rear or rearwardly facing circular opening 64 for receiving the front or forwardly facing end portion 66 of the battery housing 40 such that the longitudinal axis b is parallel to the longitudinal axis a and perpendicularly spaced therefrom by a distance D (FIG. 3).

As used herein, "forward" indicates the same direction as that of the light beam which may be produced by the light generator apparatus, i.e. the direction in which the barrel 16 of the firearm 12 is pointed when the light generator apparatus 32 is secured to the firearm 12 with the longitudinal axis b parallel to the longitudinal axis c of the barrel 16. "Rearward" indicates the direction opposite the forward direction.

With the battery housing 40 and the light source housing 44 secured to the coupler 50, the first lamp terminal spring 68 is in electrical connection with button contact 70 held by circuit board 71 in the coupler 50, such electrical connection continuing to flexible conductive wire 72 rearwardly extending, with some slack, from the circuit board 71 through the coupler rear opening 64, passing through an aperture 74 in the battery housing front end portion 66 and in electrical connection with battery contact spring 76 held within the battery housing 40 by insulator 78.

With the tail cap assembly 52 in place and the batteries 42 between battery contact springs 76, 80, the lamp will be energized upon contact by the tail switch contact surface 82 with the annular rear end 84 of the electrically conductive battery housing 40, completing the circuit to the second lamp terminal spring 86 in electrical contact with the electrically conductive coupler 50 which in turn is in electrical contact with the battery housing 40.

The front end 66 of the battery housing 40 and the rear end 88 of the coupler 50, situated within the coupler rear opening 64, are configured for interfacing one with the other along the longitudinal axis a, with the longitudinal axis b spaced by the distance D from the longitudinal axis a along one or another of at least two orientations or angular dispositions of the longitudinal axis b with respect to the longitudinal axis a. The battery housing front end 66 includes a longitudinal projection 90 forwardly extending along longitudinal axis a from a base surface 92, the projection 90 in this preferred embodiment having a flat forward face 94 and bounded by at least two longitudinally directed lateral surfaces 96 angularly disposed with respect to each other. The projection 90 further includes at least two threaded longitudinal apertures 98 associated with the sides 96, each bore 98 preferably spaced perpendicularly from its associated side or sides 96 by a line passing through the longitudinal axis a with each bore 98 equally spaced from the axis a.

The lateral surfaces 96 of the longitudinal projection 90 may be configured as being along respective sides of a polygon, preferably an equilateral polygon centered along the longitudinal axis a. In the preferred embodiment shown in FIG. 5, the lateral surfaces 96 are configured along respective sides of a square, and the projection 90 includes three threaded apertures 98 situated within the square.

The rear end 88 of the coupler 50 includes a longitudinal recess 100 having at least two longitudinally directed lateral surfaces 102 forwardly extending from a base surface 104 within the coupler rear opening 64. The recess 100 is configured to fittingly receive the projection 90, preferably by a slip fit, with the coupler lateral surfaces 102 complementing the battery housing lateral surfaces 96, when the coupler rear end 88 is placed to the battery housing front end 66, restraining the coupler 50 against rotational and lateral movement with respect to the battery housing's longitudinal axis a. A longitudinal bore 106 through the coupler leg portion 62, preferably through the recess 100, receives a headed bolt or screw 108 for being threadedly received by an aligned one of the threaded apertures 98, for longitudinally fastening the coupler 50 to the battery housing 40.

When placing the coupler 50 to the battery housing 40, the coupler circular rear opening 64 is placed for fittingly receiving the battery housing front end portion 66 along the battery housing's longitudinal axis a. During such placing, the projection 90 is fittingly received by the recess 100 such that the longitudinal axis b is in one of at least two offset orientations or angular dispositions about the longitudinal axis a. In the preferred embodiment shown in FIGS. 5, 6 and 8, the square projection 90 is fittingly received by the complementary square recess 100 in any one of three incremental rotational positions about the longitudinal axis a.

Figure 2:
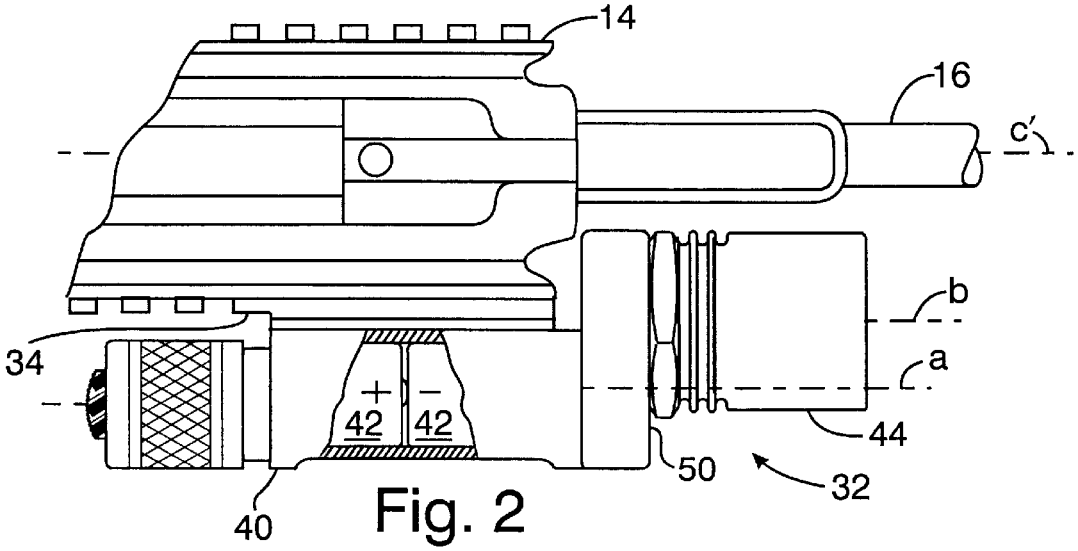
FIG. 2 is a top plan view, partially broken away and partially fragmentary, of the preferred embodiment of the invention and firearm of FIG. 1, shown in increased scale.
Figure 8:
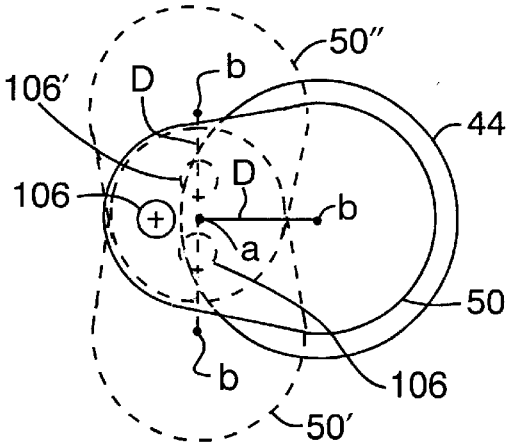
FIG. 8 is a schematic representation of the orientation positions of the coupler of the preferred light generator apparatus, viewed from the front with the solid line representing the coupler orientation as shown in FIG. 1.

In a first such orientation, specifically where the light housing longitudinal axis b is angularly disposed in a horizontal orientation towards the firearm barrel 16 as shown in FIGS. 1, 2 and 8, the square projection 90 is received within the square recess 100 with the projection lateral surface 96A engaging the recess lateral surface 102A, projection surface 96B engaging recess surface 102B, projection surface 96C engaging recess (discontinuous) surface 102C, and projection surface 96D engaging recess surface 102D. At such orientation, the coupler bore 106 is longitudinally aligned with the threaded bore 98A, and the threaded screw 108 is inserted through the bore 106 (the head of the screw 108 being retained in the coupler 50 by the lip 110, see FIG. 7) for threadably engaging the threaded bore 98A. The engagement of the projection lateral surfaces 96 with such recess lateral surfaces 102 restrains the coupler 50 against rotational and lateral movement with respect to the battery housing's longitudinal axis a, while the coupler 50 is longitudinally secured to the battery housing 40 by the screw 108/bore 98A combination, with the light source housing longitudinal axis b spaced from the battery housing longitudinal axis a by the distance D and horizontally disposed therefrom as schematically shown by the solid line representation of FIG. 8.

When it is desired to incrementally change the offset orientation or angular disposition of the light source housing longitudinal axis b with respect to the battery housing longitudinal axis a, the coupler 50 is unfastened from the battery housing 40 by removing the screw 108 from the threaded bore 98A and longitudinally withdrawing the coupler 50 from the battery housing 40 until the projection 90 is no longer received by the recess 100. The flexible conductive wire 72 electrically coupling the lamp's first terminal contact 70 to the battery terminal spring 76, remains connected between circuit board 71 in the coupler 50 and the battery terminal spring contact 76 in the battery housing 40, the slack of the wire 72 having been taken up and stored within the aperture 74 through the battery housing front end 84, so that the coupler 50 may be longitudinally withdrawn from the battery housing 40 by a longitudinal distance equal to the extended slack length of the wire 72. When the coupler recess 100 is withdrawn from the battery housing projection 90, the coupler 50 may be manually rotated about the longitudinal axis a for placing the light source housing longitudinal axis b in another offset orientation or angular disposition with respect to the battery housing longitudinal axis a.

The coupler 50 may be rotated clockwise or downwardly, as schematically indicated in FIG. 8 by the dashed line representation 50' of the coupler, and the rotated coupler 50 is longitudinally replaced to the battery housing 40 such that the square projection 90 is fittingly received within the square recess 100 with the projection lateral surface 96A engaging the recess lateral surface 102D, projection surface 96B engaging recess surface 102A, projection surface 96C engaging recess surface 102B, and projection surface 96D engaging recess (discontinuous) surface 102C. At such second orientation, the coupler bore (indicated by the dashed line representation 106' in FIG. 8) is longitudinally aligned with threaded bore 98B, and the threaded screw 108 is inserted through the bore 106 for threadably engaging the threaded bore 98B. The engagement of such projection lateral surfaces 96 with such recess lateral surfaces 102 restrains the coupler 50 against rotational and lateral movement with respect to the battery housing's longitudinal axis a, while the coupler 50 is longitudinally secured to the battery housing 40 by the screw 108/bore 98B combination, with the light source housing longitudinal axis b spaced from the battery housing longitudinal axis a by the distance D and vertically downwardly disposed therefrom (dashed line representation 50' of the coupler shown in FIG. 8). In the preferred embodiment, then, this second offset orientation or angular displacement of the longitudinal axis b from the longitudinal axis a is approximately 90° (to the right) from the previously described first offset orientation or angular displacement.

For incrementally affecting yet another or third offset orientation or angular disposition of the light source housing longitudinal axis b with respect to the battery housing longitudinal axis a, the coupler 50 is unfastened from the battery housing 40 by removing the screw 108 from the threaded bore 98A if the coupler is in the first orientation or from the threaded bore 98B if the coupler is in the second orientation. The coupler 50 is longitudinally withdrawn from the battery housing 40 until the projection 90 is no longer received by the recess 100, and the coupler 50 is manually rotated about the longitudinal axis a, counterclockwise or upwardly as schematically indicated in FIG. 8 by the dashed line representation 50" of the coupler, and the coupler 50 is then longitudinally replaced to the battery housing 40 such that the square projection 90 is received within the square recess 100 with the projection lateral surface 96A engaging the recess lateral surface 102B, projection surface 96B engaging recess (discontinuous) surface 102C, projection surface 96C engaging recess surface 102D, and projection surface 96D engaging recess surface 102A. At such third orientation, the coupler bore (indicated by the dashed line representation 106" in FIG. 8) is 8) is longitudinally aligned with threaded bore 98D, and the threaded screw 108 is inserted through the bore 106 for threadably engaging the threaded bore 98D. The engagement of such projection lateral surfaces 96 with such recess lateral surfaces 102 restrains the coupler 50 against rotational and lateral movement with respect to the battery housing's longitudinal axis a, while the coupler 50 is longitudinally secured to the battery housing 40 by the screw 108/bore 98D combination, with the light source housing longitudinal axis b spaced from the battery housing longitudinal axis a by the distance D and vertically downwardly disposed therefrom (dashed line representation 50" of the coupler shown in FIG. 8). In the preferred embodiment, then, this third offset orientation or angular displacement of the longitudinal axis b from the longitudinal axis a is approximately 90° (to the left) from the previously described first offset orientation or angular displacement.

Either of the second or third offset orientations or angular dispositions of the longitudinal axis b with respect to the longitudinal axis a places the light source housing 44 a greater distance away from the firearm barrel 16 than does the first offset orientation or angular disposition of the longitudinal axis b with respect to the longitudinal axis a. Such greater distance would permit a greater diameter light source housing to be used in the light beam projection apparatus 32 of the present invention, as well as permitting the light beam projection apparatus 32 to be used on firearms equipped with accessories ordinarily blocking a light beam generated from a non-offset light beam generator. Such accessories may include, for example, a large diameter noise suppressor attached to the forward end of the firearm barrel 16.

It may be appreciated that the distance of the light source housing longitudinal axis b from the firearm barrel 16 may be even further increased, by modifying or decreasing the major diameter of the wire storage aperture 74 in the battery housing front end 66 and placing a fourth threaded bore 98 in the projection 90 opposite the bore 98A, for permitting the coupler 50 to be secured to the battery housing 40 in a horizontal position directed away from the firearm barrel 16, i.e. for affecting a fourth incremental offset orientation or angular disposition of the light source housing longitudinal axis b with respect to the battery housing longitudinal axis a.

Figure 9:
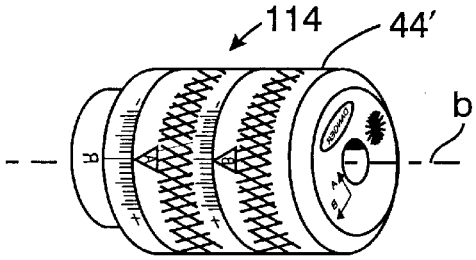
FIG. 9 is a perspective view of a laser sight module for being secured to the coupler of the present invention, for assisting in aiming of the firearm.

A laser sight assembly may replace the previously discussed lamp assembly 46, within the light source housing 44' of the laser sight module 114 shown in FIG. 9, adapted for being secured the coupler 50 with its longitudinal axis b parallel to the firearm barrel 16. Such laser sight modules 114 are well known in the firearms art, such as those manufactured and distributed by SureFire, LLC and its predecessor-in-interest Laser Products Ltd. (both of Fountain Valley, Calif.).

Thus, there has been described a preferred embodiment of an apparatus and method for incrementally adjusting orientation offset of a light beam generator adapted to be mounted to a firearm. Although the preferred embodiment includes a longitudinal projection on the battery housing front end and a longitudinal recess on the coupler rear end for fittingly receiving the projection, other embodiments may include the longitudinal projection on the coupler rear end and the longitudinal recess on the battery housing front end. Other embodiments of the present invention and variations of the embodiment described herein may be developed without departing from the essential characteristics thereof. Accordingly, the invention should be limited only by the scope of the claims listed below.

I claim:

1. In a light beam generator apparatus for a firearm having a barrel, the combination comprising:

a battery housing having a first longitudinal axis and adapted to be secured to the firearm with said first longitudinal axis parallel to said barrel;

a light source housing having a second longitudinal axis;

a coupler secured to said light source housing, said coupler and said battery housing adapted for longitudinally placing said coupler to said battery housing with said second longitudinal axis parallel to said first longitudinal axis and spaced from said first longitudinal axis along one or another of at least two angular dispositions of said second longitudinal axis with respect to said first longitudinal axis, successive ones of said at least two angular dispositions being separated by predetermined angles respectively; and a fastener fastening said coupler to said battery housing when said coupler is placed to said battery housing with said second longitudinal axis along one or another of said at least two angular dispositions.

2. The apparatus according to claim 1, wherein:

said predetermined angles are approximately 90°.

3. The apparatus according to claim 1, wherein:

said light source housing houses a lamp assembly for illuminating a target.

4. The apparatus according to claim 1, wherein:

said light source housing houses a laser assembly for assisting aiming of the firearm.

5. The apparatus according to claim 1, wherein:

said battery housing includes a front end; and said coupler includes a rear end interfacing with said front end when said coupler is longitudinally placed to said battery housing.

6. The apparatus according to claim 5 wherein:

one of said front end and said rear end includes a longitudinal projection and the other of said front end and said rear end includes a longitudinal recess for longitudinally receiving said projection, said projection and said recess configured for longitudinally placing said coupler to said battery housing with said second longitudinal axis along one or another of said at least two angular dispositions.

7. In a light beam generator apparatus for a firearm having a barrel, the combination comprising:

a battery housing having a first longitudinal axis and adapted to be secured to the firearm with said first longitudinal axis parallel to said barrel;

a light source housing having a second longitudinal axis;

a coupler secured to said light source housing, said coupler and said battery housing adapted for longitudinally placing said coupler to said battery housing with said second longitudinal axis parallel to said first longitudinal axis and spaced from said first longitudinal axis along one or another of at least two angular dispositions of said second longitudinal axis with respect to said first longitudinal axis;

a fastener fastening said coupler to said battery housing when said coupler is placed to said battery housing with said second longitudinal axis along one or another of said at least two angular dispositions;

said battery housing includes a front end;

said coupler includes a rear end interfacing with said front end when said coupler is longitudinally placed to said battery housing; and said front end includes a longitudinal projection having at least two lateral surfaces spaced about said first longitudinal axis, said rear end includes a longitudinal recess having at least two lateral surfaces complementing said lateral surfaces of said front end when said projection is received by said recess, the angular dispositions of said surfaces about said first longitudinal axis corresponding to the angular dispositions of said second longitudinal axis with respect to said first longitudinal axis when said projection is received by said recess.

8. The apparatus according to claim 7 wherein said fastener includes:

a threaded screw;

a bore through said rear end for receiving said screw; and at least two threaded longitudinal bores in said front end spaced about said first longitudinal axis such that said screw is threadedly received by one or another of said threaded bores corresponding to one or another of said at least two angular dispositions of said second longitudinal axis.

9. In a light beam generator apparatus for a firearm having a barrel, the combination comprising:

a battery housing having a first longitudinal axis and adapted to be secured to the firearm with said first longitudinal axis parallel to said barrel;

a light source housing having a second longitudinal axis;

a coupler secured to said light source housing, said coupler and said battery housing adapted for longitudinally placing said coupler to said battery housing with said second longitudinal axis parallel to said first longitudinal axis and spaced from said first longitudinal axis along one or another of at least two angular dispositions of said second longitudinal axis with respect to said first longitudinal axis;

a fastener fastening said coupler to said battery housing when said coupler is placed to said battery housing with said second longitudinal axis along one or another of said at least two angular dispositions;

said battery housing includes a front end;

said coupler includes a rear end interfacing with said front end when said coupler is longitudinally placed to said battery housing; and one of said front end and said rear end includes a longitudinal projection having lateral surfaces respectively along sides of a polygon, the other of said front end and said rear end includes a longitudinal recess having lateral surfaces respectively along sides of a polygon, said lateral surfaces of said projection engaging said lateral surfaces of said recess when said projection is received by said recess for preventing rotation of said coupler about said first longitudinal axis with said second longitudinal axis along one or another of said at least two angular dispositions.

10. The apparatus according to claim 9 wherein said fastener includes:

a threaded screw;

a bore through said rear end for receiving said screw; and at least two threaded longitudinal bores in said front end spaced about said first longitudinal axis such that said screw is threadably received by one or another of said threaded bores corresponding to said at least two angular dispositions of said second longitudinal axis.

11. The apparatus according to claim 9, wherein:

said polygons are equilateral polygons, with said polygon of said front end centered along said first longitudinal axis.

12. The apparatus according to claim 9 wherein:

said polygons are squares.

13. The apparatus according to claim 12 wherein:

said fastener includes a threaded screw, a bore through said rear end for receiving said screw, and three threaded longitudinal bores in said front end spaced about said first longitudinal axis such that said screw is threadably received by one or another of said threaded bores corresponding to one or another of three angular dispositions of said second longitudinal axis with respect to said first longitudinal axis.

14. In a light beam generator apparatus for a firearm having a barrel, the combination comprising:

a battery housing having a first longitudinal axis and adapted to be secured to the firearm with said first longitudinal axis parallel to said barrel;

a light source housing having a second longitudinal axis;

a coupler secured to said light source housing, said coupler and said battery housing adapted for longitudinally placing said coupler to said battery housing with said second longitudinal axis parallel to said first longitudinal axis and spaced from said first longitudinal axis along one or another of at least two angular dispositions of said second longitudinal axis with respect to said first longitudinal axis;

a fastener fastening said coupler to said battery housing when said coupler is placed to said battery housing with said second longitudinal axis along one or another of said at least two angular dispositions;

said battery housing includes a front end;

said coupler includes a rear end interfacing with said front end when said coupler is longitudinally placed to said battery housing; and said front end includes a longitudinal projection having lateral surfaces respectively along sides of a polygon, said rear end includes a longitudinal recess having lateral surfaces respectively along sides of a polygon, said lateral surfaces of said projection engaging said lateral surfaces of said recess when said projection is received by said recess for preventing rotation of said coupler about said longitudinal axis with said second longitudinal axis along one or another of said at least two angular dispositions.

15. The apparatus according to claim 14 wherein said fastener includes:

a threaded screw;

a bore through said rear end for receiving said screw; and at least two threaded longitudinal bores in said front end spaced about said first longitudinal axis such that said screw is threadably received by one or another of said threaded bores corresponding to said at least two angular dispositions of said second longitudinal axis.

16. The apparatus according to claim 14, wherein:

said polygons are equilateral polygons, and said polygon of said front end is centered along said first longitudinal axis.

17. The apparatus according to claim 11, wherein:

said polygons are squares.

18. The apparatus according to claim 17, wherein:

said fastener includes a threaded screw, a bore through said rear end for receiving said screw, and three threaded longitudinal bores in said front end spaced about said first longitudinal axis such that said screw is threadably received by one or another of said threaded bores corresponding to one or another of three angular dispositions of said second longitudinal axis with respect to said first longitudinal axis.

19. In a method of adjusting orientation offset of a light beam generator for a firearm having a barrel:

providing a light beam generator including a battery housing having a first longitudinal axis, a light source housing having a second longitudinal axis, and a coupler secured to said light source housing;

longitudinally placing said coupler to said battery housing with said second longitudinal axis parallel to said first longitudinal axis and spaced from said first longitudinal axis along one of at least two angular dispositions of said second longitudinal axis with respect to said first longitudinal axis, successive ones of said at least two angular dispositions being separated by predetermined angles respectively; and fastening said coupler to said battery housing.

20. The method according to claim 19, further including:

unfastening said coupler from said battery housing;

longitudinally withdrawing said coupler from said battery housing;

longitudinally replacing said coupler to said battery housing with said second longitudinal axis along another of said at least two angular dispositions; and fastening said coupler to said battery housing.

21. The method according to claim 19, wherein:

said battery housing has a front end and said coupler has a rear end, one of said front end and said rear end includes a longitudinal projection and the other of said front end and said rear end includes a longitudinal recess; and when longitudinally placing said coupler, said projection is received by said recess with said second longitudinal axis along one of said at least two angular dispositions.

22. The method according to claim 21, further including:

unfastening said coupler from said battery housing;

longitudinally separating said projection and said recess;

longitudinally replacing said coupler to said battery housing with said projection received by said recess and with said second longitudinal axis along another of said at least two angular dispositions; and fastening said coupler to said battery housing.

23. In a method of adjusting orientation offset of a light beam generator for a firearm having a barrel:

providing a light beam generator including a battery housing having a first longitudinal axis, a light source housing having a second longitudinal axis, and a coupler secured to said light source housing, said battery housing having a front end and said coupler having a rear end, said front end including a longitudinal projection having lateral surfaces respectively along sides of an equilateral polygon centered along said first longitudinal axis, said rear end including a longitudinal recess having lateral surfaces respectively along sides of an equilateral polygon;

longitudinally placing said coupler to said battery housing with said second longitudinal axis parallel to said first longitudinal axis and spaced from said first longitudinal axis along one of at least two angular dispositions of said second longitudinal axis with respect to said first longitudinal axis, and with said projection being received by said recess with said lateral surfaces of said projection engaging said lateral surfaces of said recess; and fastening said couple to said battery housing.

24. The method according to claim 23, further including:

unfastening said coupler from said battery housing;

longitudinally withdrawing said recess from said projection;

longitudinally replacing said coupler to said battery housing with said lateral surfaces of said projection engaging said lateral surfaces of said recess and with said second longitudinal axis spaced from said first longitudinal axis along another of said at least two angular dispositions; and fastening said coupler to said battery housing.

25. The method according to claim 24 wherein:

said polygons are squares; and when longitudinally replacing said coupler, said one of said at least two angular dispositions is separated from said other of at least two angular dispositions by approximately 90°.

* * * * *

UNITED STATES PATENT AND TRADEMARK OFFICE

CERTIFICATE OF CORRECTION

PATENT NO. : 6,675,521 B1
DATED : January 13, 2004
INVENTOR(S) : Paul Y. Kim

It is certified that error appears in the above-identified patent and that said Letters Patent is hereby corrected as shown below:

Title page,
Item [75], Inventor, "Westminster" should be -- Irvine --

Signed and Sealed this

Thirteenth Day of April, 2004

JON W. DUDAS
*Acting Director of the United States Patent and Trademark Office*